US005915369A

United States Patent [19]

Sheliga

[11] Patent Number: 5,915,369

[45] Date of Patent: Jun. 29, 1999

[54] LATCHING ARROW REST

[76] Inventor: Douglas J. Sheliga, 11950 Taylor Wells Rd., Chardon, Ohio 44024

[21] Appl. No.: 09/031,174

[22] Filed: Feb. 26, 1998

[51] Int. Cl.[6] ..... F41B 5/22

[52] U.S. Cl. ..... 124/44.5

[58] Field of Search ..... 124/24.1, 44.5, 124/86

[56] References Cited

U.S. PATENT DOCUMENTS

| | | | |
|---|---|---|---|
| 2,975,780 | 3/1961 | Fisher | 124/24.1 |
| 3,504,659 | 4/1970 | Babington | 124/44.5 X |
| 4,287,868 | 9/1981 | Schiff | 124/44.5 |
| 4,344,409 | 8/1982 | Barner | 124/44.5 X |
| 4,803,971 | 2/1989 | Fletcher | 124/44.5 |
| 4,865,007 | 9/1989 | Saunders | 124/44.5 |
| 4,947,832 | 8/1990 | Larson | 124/41.1 |
| 5,009,215 | 4/1991 | Ludwig | 124/44.5 |
| 5,365,912 | 11/1994 | Pittman | 124/44.5 |
| 5,415,154 | 5/1995 | Angeloni | 124/44.5 |
| 5,490,492 | 2/1996 | Savage | 124/44.5 |
| 5,592,930 | 1/1997 | Roberts et al. | 124/44.5 |
| 5,601,069 | 2/1997 | Clark | 124/44.5 |
| 5,606,961 | 3/1997 | Basik et al. | 124/44.5 |
| 5,606,962 | 3/1997 | Troncoso | 124/44.5 |
| 5,632,263 | 5/1997 | Sartain | 124/44.5 |
| 5,634,455 | 6/1997 | Troncoso | 124/44.5 |
| 5,678,530 | 10/1997 | Van Drielen | 124/44.5 |
| 5,685,287 | 11/1997 | Grey Wall | 124/44.5 |

*Primary Examiner*—John A. Ricci

[57] ABSTRACT

A manually resetable latching arrow rest is a device that supports the arrow in a shooting position, then gets pushed out of the way by the arrow with a minimum unlatching force, then can be relatched to the shooting position by the archer. The relatching is accomplished by the archer with a finger of the hand that holds the bow. The minimum unlatching force occurs while the arrow is moving forward but is still on the string. The force is negligible and constant compared to the total force of the arrow. With the rest out of the way there is nothing to deflect the arrow after the arrow leaves the string. The relatching mechanism consists of a movable pivotal reset lever that mechanically links to a lifter that subsequently moves the rest to the shooting position. The pivotal reset lever is also used to move the lifter to the no influence position after the arrow is drawn so that as the arrow is shot the lifter is totally out of the picture, only the rest is moved. The result is minimum influence by the arrow rest on the arrow during the shot and maximum consistency of arrow positioning and rest movement.

5 Claims, 4 Drawing Sheets

LATCHING ARROW REST

BACKGROUND OF THE INVENTION (1) Field of Invention

This invention relates to archery. It relates to a component on the archery bow. Most specifically, it relates to a unique arrow rest.

(2) Description of Prior Art

Available today are many types of arrow rests. All of them have some influence on the flight of the arrow. Said influence usually involves allowing the fletching of the arrow or the arrow shaft to touch some part of the arrow rest or some part of the bow, causing direction change and shooting inaccuracies. The remedy to the above problem is usually a springy pedestal on which the arrow sits. As the arrow leaves, the springy rest still touches the arrow thus maintaining an influence. Also, downward pressure (caused by the nocking point and release when the arrow is drawn) by the arrow on the springy arrow rest allows the rest to assume different vertical positions as the arrow is released. It is difficult to maintain the exact vertical position of the rest under all conditions.

This permits inconsistencies as the arrow is shot.

Others have tried to have the rest move out of the way of the arrow. They depend on the forward friction of the arrow against the rest to move the rest, or depended on some mechanism attached to bow limb or string or cable to move the rest out of the way. The forward friction of the arrow is usually inconsistent and the movement of the rest is inconsistent resulting in inaccurate shots. Some of the other mechanisms can result in inconsistent positioning of the rest and thus inaccurate shots.

The applicant's idea is unique, none of the existing patents are the same. The applicant's idea appears to be better because the rest is rigid and does not move before the arrow is shot and also the overall operation appears to be more consistent resulting in better shooting accuracy.

SUMMARY OF INVENTION

The latching arrow rest (LAR) has minimized the influence on the flight of the arrow. The rest will rigidly support the arrow in the same position every time. This support occurs in the latched position. Then the arrow will unlatch and push, using constant and minimum effort, the rest out of the way as the arrow is shot. The arrow is intentionally nocked low so that it will push the rest out of the way before the arrow leaves the string. Thus any deflection while the arrow is in the air is eliminated. Deflection while in the air appears to be the most influential in causing the arrow to miss the target. Built in minimum damping allows the rest to remain out of the way of the shot arrow. Note that the starting friction of the unlatching of rest overwhelms the damping of the rest against the latch as the rest travels out of the way, but the damping is sufficient to hold the rest out of the way. The rest, in the unlatched position can be relatched by the archer using a finger, usually index, of the bow hand.

The latching rest yields good arrow position and thus accurate arrow shots. This is because the rest is locked into the same position everytime by the spring force of the latching mechanism.

In summary, the only influence of the LAR on the flight of the arrow is the minimum energy of the arrow required to unlatch and push the rest out of the way. The fletching does not touch anything nor does the shaft touch anything else. The flight of the arrow is then clear. Also, the minimum energy required to push the arrow out of the way is constant and should affect all shots the same.

In general, the LAR will make the sport of archery more enjoyable. This is because some of the reasons the arrow miss the target are eliminated. Specifically, the arrow does not deflect off of anything after it leaves the string. The rest is already out of the way before the arrow leaves the string making the flight clear. The key advantages are minimum influence combined with maximum position consistency.

DESCRIPTION OF THE PREFERRED EMBODIMENT(S)

Figure 1:
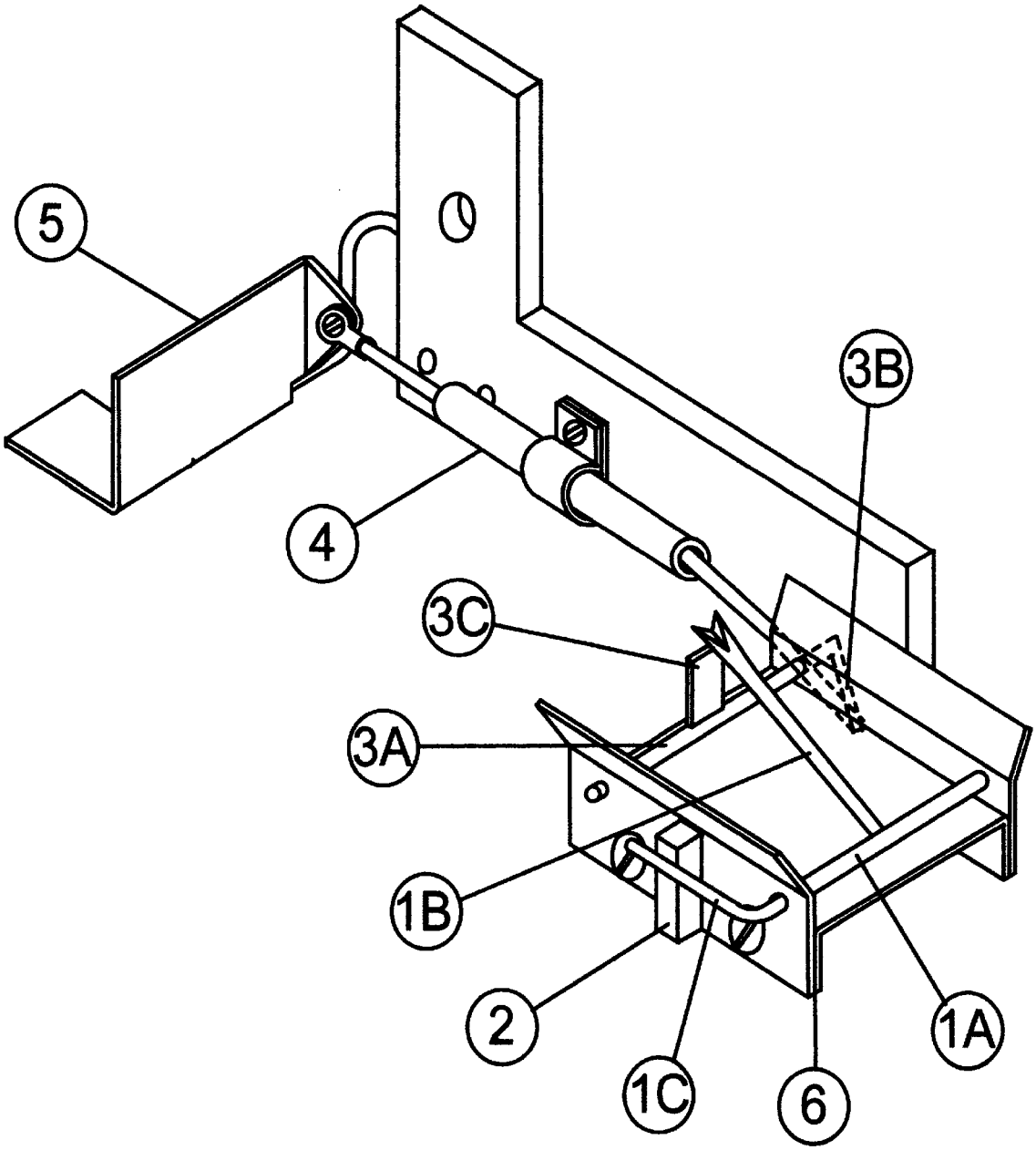
FIG. 1 is an isometric view of the invention's main parts.

The following are the designations of the preferred embodiments.

1 REST
- 1A PIVOT SHAFT
- 1B ARROW SUPPORT SHAFT
- 1C LATCH SHAFT

2 LATCH

3 LIFTER
- 3A LIFTER SHAFT
- 3B LIFTER LEVER
- 3C LIFTER EXTENSION

4 CABLE

5 PIVOTAL RESET LEVER

6 FRAME

The rest 1 includes a pivot shaft 1A pivotally connected to a frame member 6 which is attached to the bow, an arrow support shaft 1B extending perpendicularly from the pivot shaft and including a notch at the end to support an arrow, and a latch shaft 1C extending at an angle from one end of the pivot shaft and adapted to contact a latch member 2.

The lifter 3 includes a lifter shaft 3A pivotally connected to a frame member 6 which is attached to the bow, a lifter lever 3B extending perpendicularly from the lifter shaft and adapted to connect to a cable 4, and a lifter extension 3C extending perpendicularly from the lifter shaft that is adapted to raise arrow support shaft 1B.

FIG. 1 shows the relationship of the parts. The lifter extension 3C is in the raised position causing the arrow support shaft 1B to be in the raised position and the latch shaft 1C to be in the slot S of the latch member 2. The pivotal reset lever 5 is in the up position. The cable 4 transfers movement of the pivotal reset lever 5 to the lifter lever 3B to pivot the lifter shaft 3A and raise or lower lifter extension 3C.

The operation can be explained from FIG. 1. The rest 1 is shown in the raised or latched position. An arrow would be positioned on the upper surface of arrow support shaft 1B. The archer can rotate pivotal reset lever 5 generally counterclockwise down pulling the cable 4 (bicycle brake type cable) forward. The cable 4 in turn pulls lifter lever 3B. The lifter extension 3C then rotates generally clockwise down to lie flat on the surface shown. The arrow support shaft 1B remains in the up position because latch shaft 1C is in the slot of the latch 2 (described in detail later). When the arrow is shot the latch shaft 1C will unlatch and the arrow support shaft 1B will move down. The arrow is nocked slightly low on the string so that as it is shot it pushes against the arrow support shaft 1B rotating it generally counterclockwise down out of the way of the arrow fletching for maximum clearance. After the arrow is gone, the archer can rotate the pivotal reset lever 5 generally clockwise up pushing the cable 4. The cable 4 in turn rotates the lifter 3 generally counterclockwise up to the position shown in FIG. 1. This in turn rotates the rest 1 generally clockwise up. The latch shaft 1C moves up into the slot S of latch 2. Thus the rest 1 is in the latched position where it started.

Figure 2A:
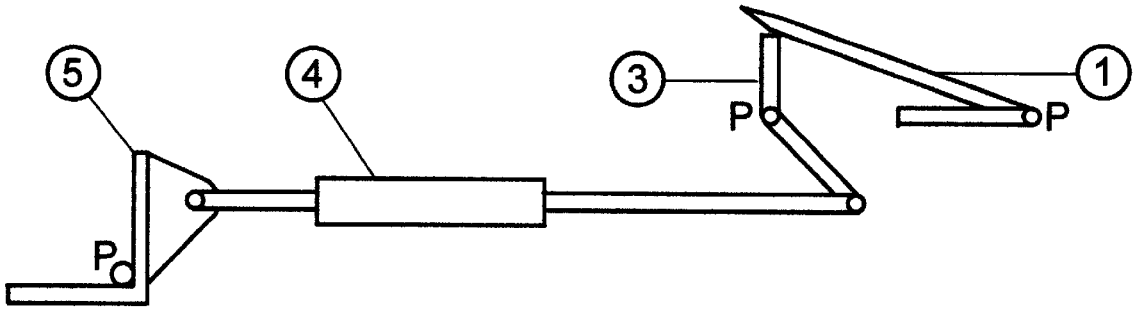
FIG. 2A, FIG. 2B and FIG. 2C are schematic diagrams of how the pivotal reset lever, cable, lifter and rest are connected and how they move. The P's are pivot points.
Figure 2B:
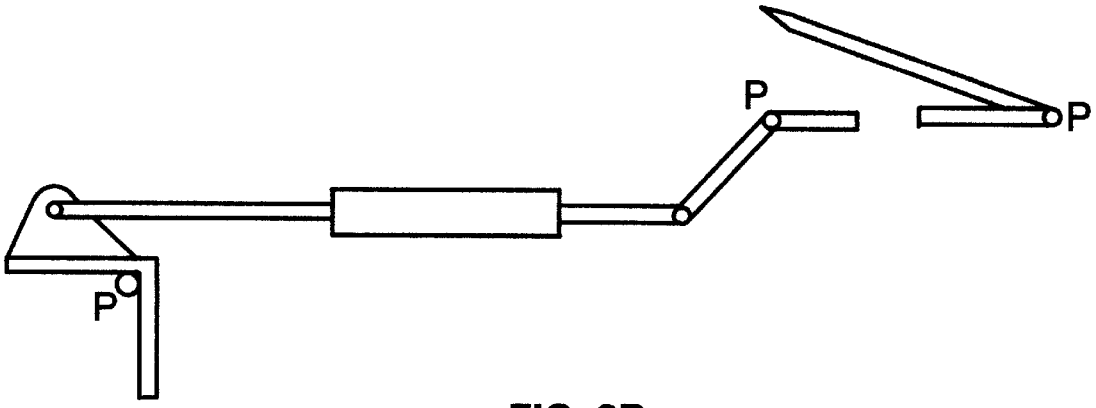
Figure 2C:
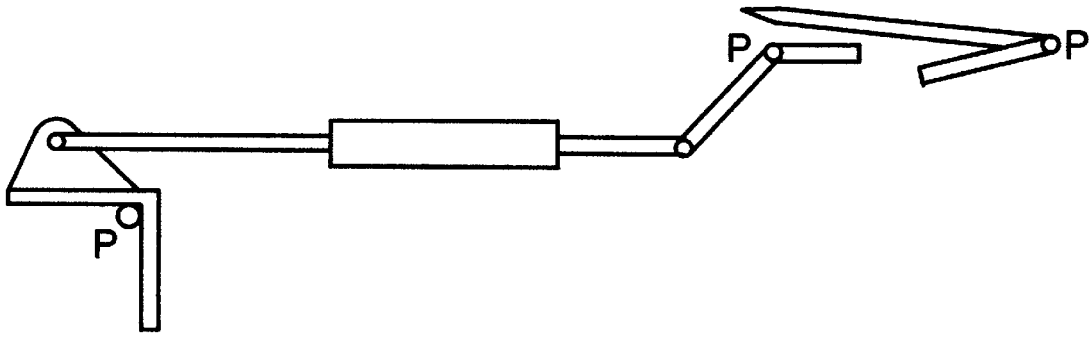

FIG. 2A, FIG. 2B and FIG. 2C show schematically how movement of the pivotal reset lever 5 is transmitted to cable 4 and then lifter 3 and subsequently to rest 1. Note that the P's represent pivot points.

FIG. 2A shows the pivotal reset lever 5 in the up position pushing the cable 4 and lifter 3 thus supporting rest 1 in the raised and latched position. This occurs when the arrow is nocked and the bow is not drawn.

FIG. 2B shows the pivotal reset lever 5 in the down position pulling the cable 4 and thus the lifter 3. The lifter 3 is out of the way of the arrow shot. The rest 1 is left in the raised and latched position, unsupported by the lifter 3. This occurs when the arrow is nocked and the bow is drawn and the archer has moved pivotal reset lever 5 down.

FIG. 2C shows the pivotal reset lever 5, cable 4 and lifter 3 in the same position as above. But it shows the rest 1 in the down position. This occurs after an arrow was shot, that is, the arrow forced the rest 1 out of the way.

Figure 3A:
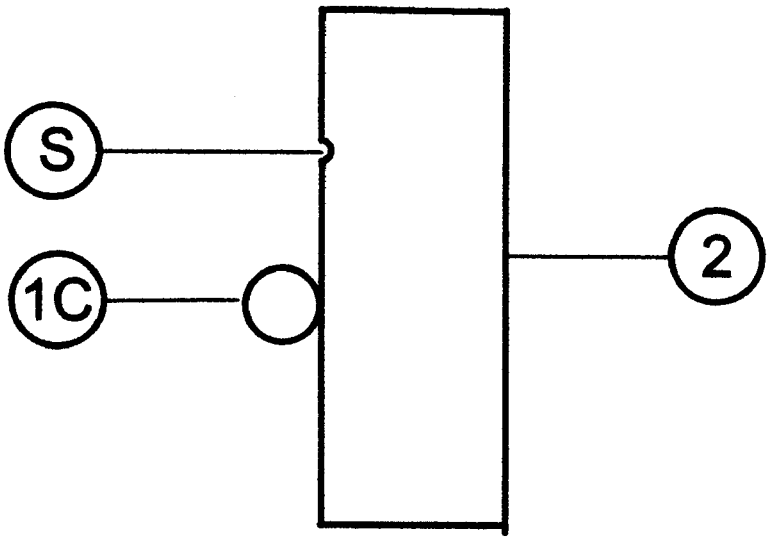
FIG. 3A and FIG. 3B illustrate how the latch shaft 1C slides on the latch 2. When the latch shaft 1C is in the slot S it is latched as shown in FIG. 3B.

FIG. 3A shows latch shaft 1C in the unlatched position and thus it is not in the slot S of latch 2.

Figure 3B:
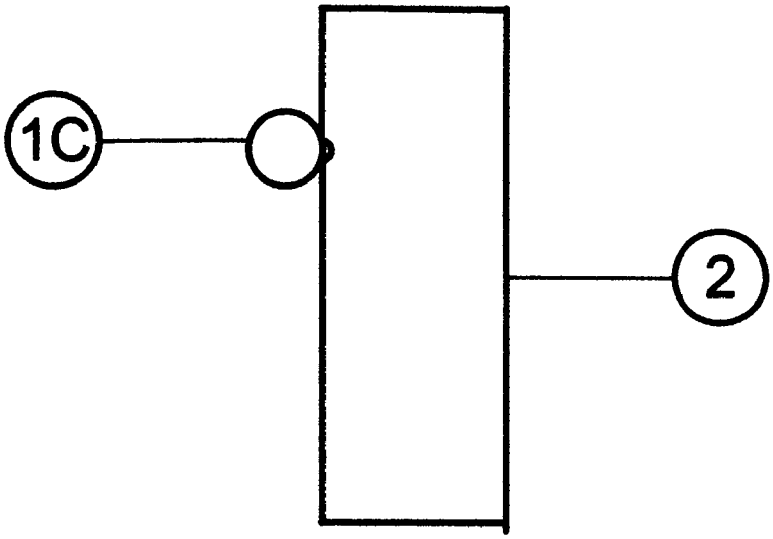

FIG. 3B shows latch shaft 1C in the slot S of latch 2 and thus the rest is considered to be in the latched position.

Figure 4A:
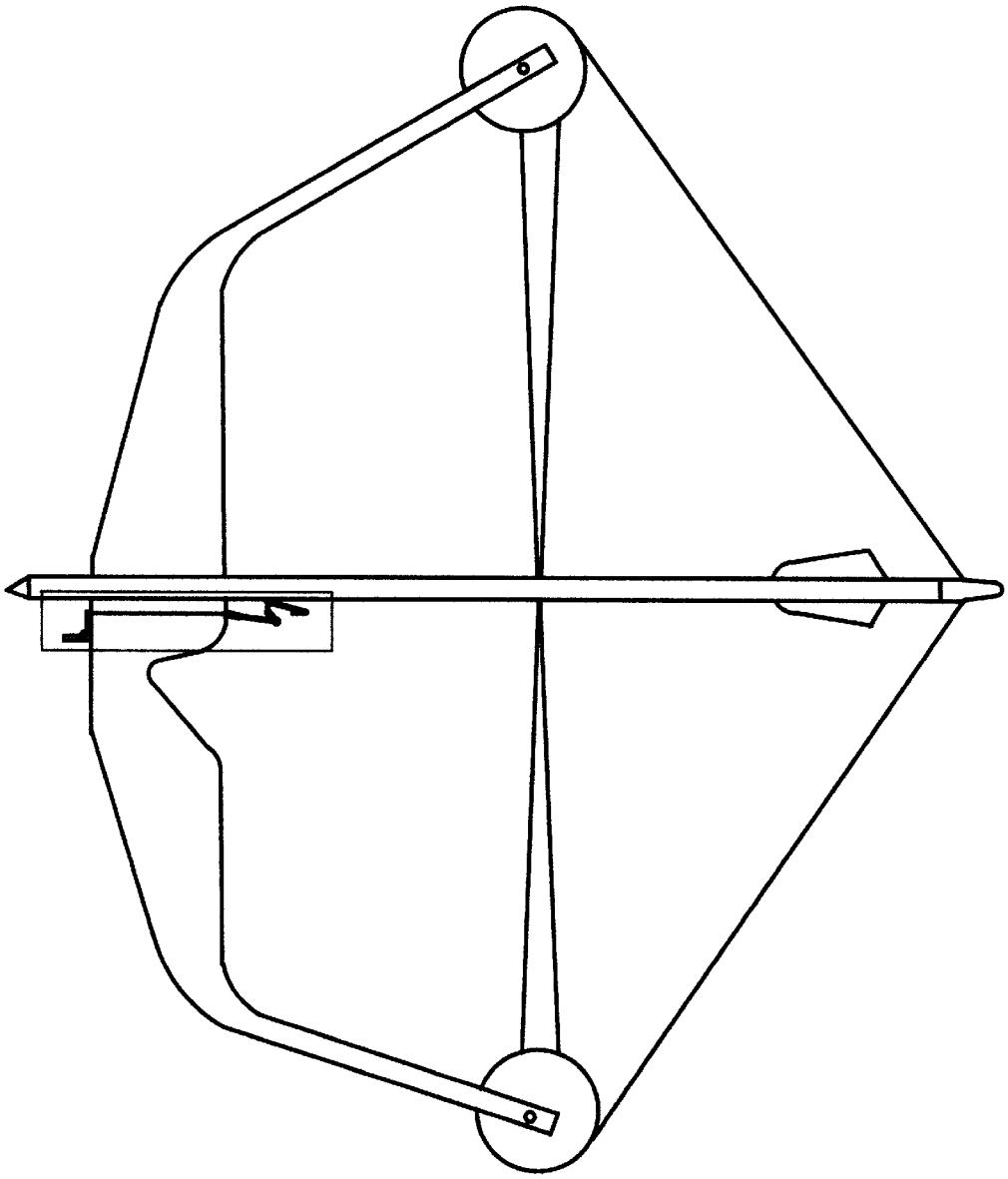
FIG. 4 illustrates the general mounting position on the bow of the main components of the latching arrow rest. The supporting components are not shown for clarity.
Figure 4B:
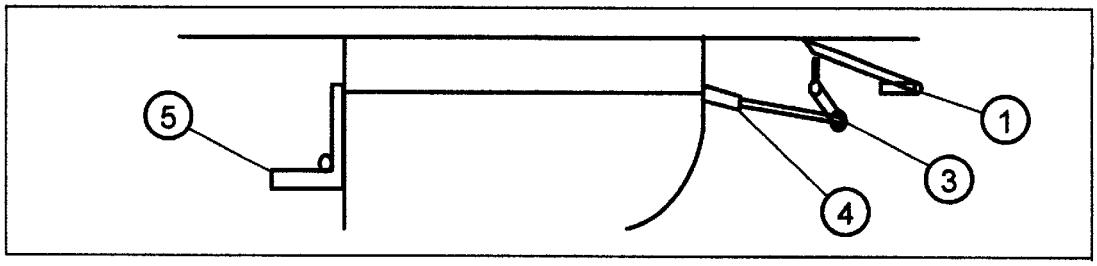

FIG. 4 shows the general location of the main components of this invention as they would be positioned on a typical archery bow. The rest 1 supports the arrow, the lifter 3 supports the rest 1, the cable 4 connects the lifter 3 to the pivotal reset lever 5 which is mounted on the bow where the a finger on the archers bow hand can operate it.

The LAR is manually resetable by the index finger of the left hand (using a right handed archer as an example). The left hand is the hand on the bow. The index finger, first finger from the thumb, moves a pivotal reset lever that is connected with a cable that subsequently moves the lifter and subsequently moves the rest to the raised position. All of this can be accomplished while both hands remain on the bow and on the string, with the bow relaxed or fully drawn.

The lifter is a necessary item in this invention. The lifter does more than restore the rest to the raised position for shooting. The lifter holds the arrow rest up until the arrow is drawn. It is necessary to support the arrow until then. With the bow undrawn, the weight of the arrow will cause the rest to unlatch and collapse. With the bow drawn, the rest will support the arrow without the aid of the lifter because the rest is supporting only the tip of the arrow, which is physically less weight.

Adjustments

Latching sensitivity is adjusted by very slightly bending the latch shaft 1C that is in contact with the latch 2, see FIG. 1. Maximum sensitivity is achieved when the arm is tensioned so that an arrow cannot be supported when the bow is undrawn and so that an arrow can be supported when the arrow is fully drawn. This is tested with the lifter 2 in the down position.

Horizontal adjustment of the rest 1 is made with the two screws on either side of the latch 2 in FIG. 1.

There is no vertical adjustment of the rest 1 incorporated in the invention. Because the rest collapses out of the way, vertical adjustment is not critical. However, as good adjustment as possible should be made with the nocking point for best arrow flight.

The pivotal reset lever 5 may be adjusted toward and away from the bow and in the right and left direction to fit almost any bow.

What is claimed is:

1. For use with an archery bow which includes a handle, limbs, and a bow string defining a bow plane, with means to propel an arrow extending along a launch axis, an arrow rest comprising:

a frame attachable to said bow;

a rest member supported by said frame, said rest member comprising:

a pivot shaft pivotally carried by said frame;

an arrow support shaft secured to and extending from said pivot shaft in said bow plane, said arrow support shaft having an arrow support means at the end opposite the pivot shaft, and movable from an arrow support shaft raised position in which said arrow support shaft is effective to support an arrow in said launch axis, and an arrow support shaft lower position in which said arrow support shaft will not interfere with an arrow moving in said launch axis;

a latch shaft secured to and extending at an angle from one end of said pivot shaft;

a latch member carried by said frame, said latch member including a slot;

said latch shaft adapted to be frictionally retained in said slot in a position wherein said arrow support shaft is in said arrow support shaft raised position, wherein, as an arrow is fired from the bow, the force of the arrow against said support shaft will cause said latch shaft to be released from said slot, thereby freeing said arrow support shaft to pivot to said arrow support shaft lower position;

manually operable means to move said arrow support shaft from said lower to said raised position in preparation for launch of an arrow.

2. The arrow rest as in claim 1, wherein said latch shaft is bendable toward and away from said latch member, thereby providing a means for adjustment of the amount of force necessary to release said latch shaft from said slot.

3. The arrow rest of claim 1, wherein said means to move said arrow support shaft from said lower to said raised position comprises:

a lifter member, said lifter member comprising:

a lifter shaft pivotally carried by said frame;

a lifter extension secured to and extending perpendicularly from said lifter shaft;

a lifter lever secured to and extending at an angle from one end of said lifter shaft;

said lifter extension located directly beneath said arrow support shaft, said lifter extension pivotal between a lifter raised position in which said lifter extension is effective to contact and raise said arrow support shaft to said arrow support shaft raised position, and a lifter lower position, in which said arrow support shaft is free to return to said arrow support shaft lower position;

a hand operable actuator mounted to said bow to pivot said lifter shaft between said lifter raised and lifter lower positions.

4. The arrow rest as in claim 3, wherein said hand operable actuator is a pivotal reset lever.

5. The arrow rest as in claim 4, further comprising a cable connected between said pivotal reset lever and said lifter lever to transmit movement of said pivotal reset lever to said lifter shaft.

* * * * *